United States Patent [19]

Kashiwagura

[11] Patent Number: 4,655,179

[45] Date of Patent: Apr. 7, 1987

[54] METHOD AND APPARATUS FOR CONTROLLING AIR-FUEL RATIO IN INTERNAL COMBUSTION ENGINE

[75] Inventor: Toshimi Kashiwagura, Susono, Japan

[73] Assignee: Toyota Jidosha Kabushiki Kaisha, Aichi, Japan

[21] Appl. No.: 757,650

[22] Filed: Jul. 22, 1985

[30] Foreign Application Priority Data

Aug. 14, 1984 [JP] Japan ..... 59-168802

[51] Int. Cl.[4] ..... F02D 5/00

[52] U.S. Cl. ..... 123/326; 123/492; 123/493

[58] Field of Search ..... 123/325, 326, 492, 493

[56] References Cited

U.S. PATENT DOCUMENTS 4,457,283 7/1984 Kobayashi et al. ..... 123/493 X
4,466,413 8/1984 Oonishi et al. ..... 123/493
4,490,792 12/1984 Deutsch et al. ..... 123/493 X
4,502,448 3/1985 Otobe ..... 123/493 X
4,510,911 4/1985 Otobe ..... 123/493
4,527,521 7/1985 Hasegawa et al. ..... 123/326

FOREIGN PATENT DOCUMENTS 0035320 3/1978 Japan .
0108127 8/1979 Japan .
0049537 4/1980 Japan .

*Primary Examiner*—Willis R. Wolfe, Jr.
*Attorney, Agent, or Firm*—Kenyon & Kenyon

[57] ABSTRACT

In an internal combustion engine, fuel enrichment is carried out when an acceleration state occurs after a transition from a fuel cut-off state to a fuel cut-off recovery state, the fuel enrichment is determined by taking into consideration the amount of fuel supplied to the engine between the above-mentioned transition and the occurrence of the acceleration state.

24 Claims, 20 Drawing Figures

METHOD AND APPARATUS FOR CONTROLLING AIR-FUEL RATIO IN INTERNAL COMBUSTION ENGINE

BACKGROUND OF THE INVENTION

1. Field of the Invention

The present invention relates to a method and apparatus for controlling the air-fuel ratio in an internal combustion engine in which a fuel cut-off control is carried out.

2. Description of the Related Art

In general, fuel cut-off control is effected to stop the injection of fuel during deceleration, thereby improving fuel consumption. The control of the fuel cut-off depends upon the opening of a throttle valve, the engine speed, and the like. For example, when the throttle valve is completely closed and the engine speed is higher than a predetermined fuel cut-off engine speed, fuel cut-off is activated. Contrary to this, when the throttle valve is not completely closed or when the engine speed is lower than a predetermined fuel cut-off recovery engine speed, fuel cut-off is released. In this case, the fuel cut-off engine speed is higher than the fuel cut-off recovery engine speed, thereby obtaining the hysteresis characteristics of the engine speed. In addition, both the fuel cut-off engine speed and the fuel cut-off recovery engine speed are dependent upon engine state parameters such as the coolant temperature of the engine.

If such a fuel cut-off control is applied to a single point injection (SPI) type engine in which a combustion chamber of each cylinder is distant from an injection valve common for all cylinders, fuel adhered to the inner wall of an intake air manifold is also injected into the combustion chambers during a fuel cut-off period. As a result, the intake air manifold is completely drained, that is, no fuel adheres to the inner wall of the intake air manifold. Subsequently, even when the engine speed becomes lower than the fuel cut-off recovery speed, thereby restarting fuel injection, a long time period elapses before fuel saturation within the intake air manifold is achieved. That is, during such a long period, only a small amount of fuel is injected into the combustion chambers. Therefore, even if the engine is set in an acceleration mode during such a long period, the fuel within the combustion chambers is drained to increase the air-fuel ratio, thus deteriorating the drivability, i.e., generating lag or vibration in the engine.

To improve the drivability, there is known an internal combustion engine wherein fuel enrichment is carried out when the engine is switched from a deceleration mode to an acceleration mode after the fuel cut-off continues for a period longer than a predetermined period (see: Japanese Examined Patent Publication No. 56-42739).

In the above-mentioned prior art, however, a predetermined amount of fuel enrichment is injected into the engine irrespective of the duration of the period after the fuel cut-off recovery, and an excess of fuel may be injected into the engine, which is disadvantageous from the viewpoint of fuel consumption.

SUMMARY OF THE INVENTION

It is an object of the present invention to provide a method and apparatus for controlling the air-fuel ratio in an internal combustion engine in such a manner that a low fuel consumption is attained.

According to the present invention, in an internal combustion engine, fuel enrichment is carried out when an acceleration state occurs after a transition from a fuel cut-off state to a fuel cut-off recovery state. The amount of fuel enrichment is determined by taking into consideration the amount of fuel supplied to the engine between the above-mentioned transition period and the occurence of the acceleration mode. That is, a suitable amount of fuel enrichment is injected into the engine in an acceleration mode after the fuel cut-off recovery, and the fuel enrichment amount for the acceleration mode is smaller when the duration of the period after the fuel cut-off recovery is longer, thus improving the fuel consumption.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
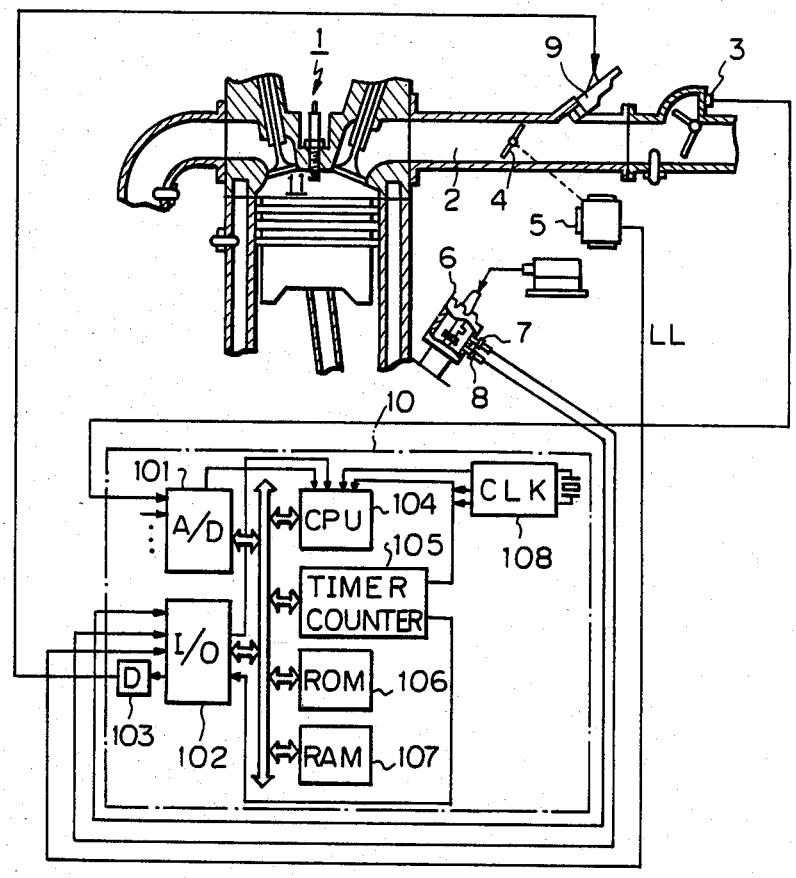
FIG. 1 is a schematic diagram of an internal combustion engine according to the present invention.

In FIG. 1, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3. The airflow meter 3 is used for detecting the amount of air taken into the engine 1 to generate an analog voltage signal in proportion to the amount of air flowing therethrough, and transmits an output signal to a multiplexer-incorporating analog-to-digital (A/D) converter 101 of a control circuit 10.

Provided in the intake air passage 2 is a throttle valve 4 which has an idling position switch 5 at the shaft thereof. The idling-position switch 5 detects whether or not the throttle valve 4 is completely closed, i.e., in an idling position, to generate an idling signal "LL".

Disposed in a distributor 6 are crank angle sensors 7 and 8 for detecting the angle of the crankshaft (not shown) of the engine 1. In this case, the crank angle sensor 7 generates a pulse signal at every 720° crank angle (CA) while the crank angle sensor 8 generates a pulse signal at every 30° CA. The pulse signals of the crank angle sensors 7 and 8 are supplied to the I/O interface 102 of the control circuit 10. In addition, the pulse signal of the crank angle sensor 8 is then supplied to an interruption terminal of a central processing unit (CPU) 104.

Additionally provided in the air-intake passage 2 is a fuel injection valve 9 for supplying pressurized fuel from the fuel system (not shown) to the intake air ports of the cylinders of the engine 1. Note that the fuel injection valve 9 is provided commonly for all cylinders. In this SPI type engine, the fuel injection valve 9 is distant from each combustion chamber 11.

The control circuit 10, which may be constructed by a microcomputer, includes a driver circuit 103 for driving the fuel injection valve 9, a timer counter 105, a read-only memory (ROM) 106 for storing a main routine, interrupt routines such as a fuel injection routine, an ignition timing routine, tables (maps), constants, etc., a random access memory 107 (RAM) for storing temporary data, a clock generator 108 for generating various clock signals, and the like, in addition to the A/D converter 101, the I/O interface 102, and the CPU 104.

The timer counter 105 may include a free-run counter, a compare register, a comparator for comparing the content of the free-run counter with that of the compare register, flag registers for compare interruption, injection control, and the like. Of course, the timer counter 105 also may include a plurality of compare registers and a plurality of comparators. In this case, the timer counter 105 is used for controling the injection start and end operation.

Interrruptions occur at the CPU 104, when the A/D converter 101 completes an A/D conversion and generates an interrupt signal; when the crank angle sensor 8 generates a pulse signal; when the timer counter 105 generates a compare interrupt signal; and when the clock generator 108 generates a special clock signal.

The intake air amount data Q of the airflow meter 3 is fetched by an A/D conversion routine executed at every predetermined time period and is then stored in the RAM 107. That is, the data Q in the RAM 107 is renewed at every predetermined time period. The engine rotational speed $N_e$ is calculated by an interrupt routine executed at 30° CA, i.e., at every pulse signal of the crank angle sensor 8, and is then stored in the RAM 108.

The operation of the control circuit 10 of FIG. 1 will be explained with reference to FIGS. 2 through 11.

Figure 2:
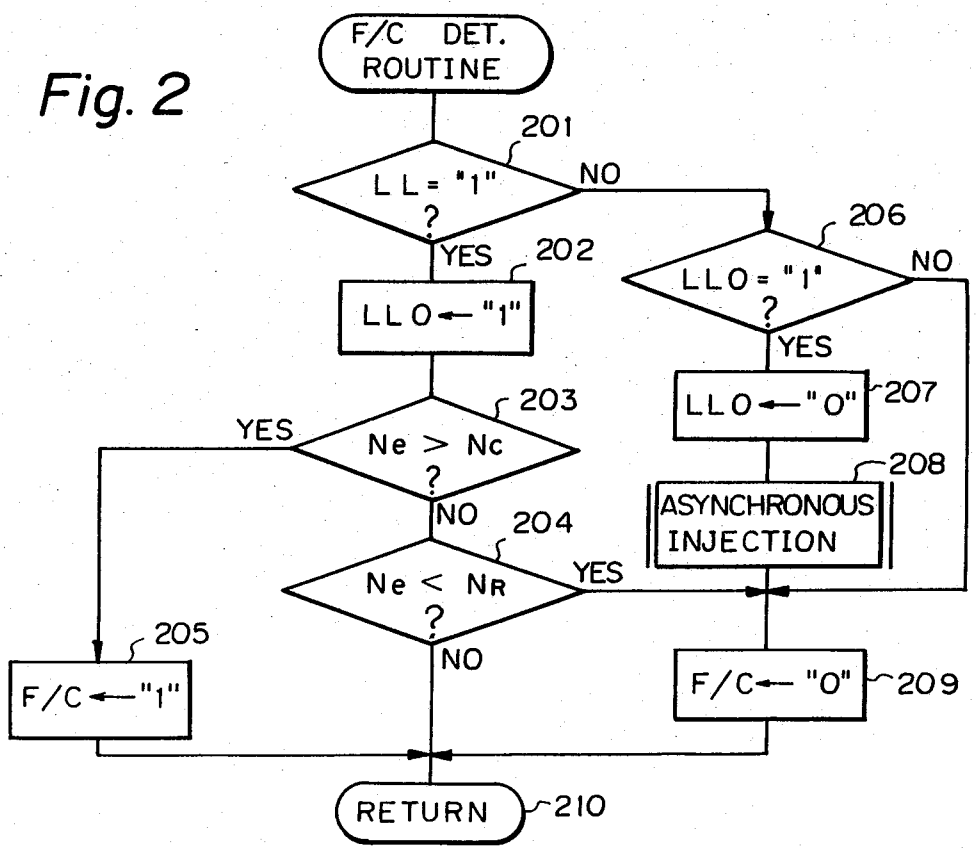
FIGS. 2, 4A through 4E, and 5 through 10 are flow charts showing the operation of the control circuit of FIG. 1.
Figure 3:
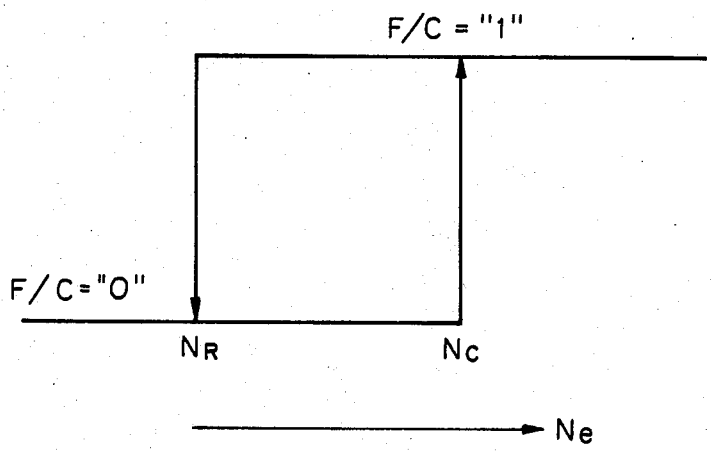
FIG. 3 is a characteristic diagram of the fuel cut-off flag F/C used in FIG. 2.

FIG. 2 is a routine for the determination of a fuel cut-off flag F/C executed at every predetermined time period or as one part of the main routine. That is, this routine is used for the determination of a flag F/C as shown in FIG. 3. In FIG. 3, $N_c$ designates a fuel cut-off engine speed, and $N_R$ designates a fuel cut-off recovery engine speed. All of the values $N_c$ and $N_R$ are dependent upon the engine coolant temperature.

At step 201, it is determined whether or not the output signal LL of the idling position switch 5 is "1", i.e., whether or not the engine 1 is in an idling state. If in an idling state, at step 202, "1" is set in LL0 as the previous value LL for the preparation of the next execution of this routine, and then the control proceeds to step 203. At step 203, the engine speed $N_e$ is read out of the RAM 107, and is compared with the fuel cut-off engine speed $N_c$, and at step 204, the engine speed $N_e$ is compared with the fuel cut-off recovery engine speed $N_R$. As a result, if $N_e > N_c$, the control proceeds to step 205 which sets the flag F/C, i.e., F/C←"1", and if $N_e < N_R$, the control proceeds to step 209 which resets the flag F/C. If $N_R \leqq N_e \leqq N_c$, the control proceeds directly to step 210, so that the flag F/C is unchanged, and accordingly, remains at the previous state.

On the other hand, if LL="0" at step 201, the control proceeds to step 206 which determines whether or not the previous value LL0 of the output LL of the idling-position switch 5 is "1". If LL0="1", this means a first change from an idling state to a non-idling state. In this case, an acceleration state is detected by this step. If an acceleration state is detected by step 206, the control proceeds to step 207 which resets the value LL0 for the preparation of the next execution. Then, at step 208, an asynchronous injection operation according to the present invention is carried out. Note that this step 208 will be later explained in detail. In this case, since the engine is in a non-idling state, the control further proceeds to step 209 which clears the fuel cut-off flag F/C.

At step 206, if LL0="0", the control also proceeds to step 209 which clears the flag F/C.

That is, if in a non-idling state, the flag F/C is "0" irrespective of the engine speed $N_e$, thereby not carrying out a fuel cut-off operation.

Although, in FIG. 2, an acceleration state is detected by the output of the idling-position switch 5, such an acceleration state can be detected by other driving parameters such as the intake air amount Q, the intake air pressure, and the engine speed $N_e$. Modifications of steps 206 through 208 are shown in FIGS. 4A through 4E. Note that the step 202 of FIG. 2 is unnecessary in these modifications.

Figure 4A:
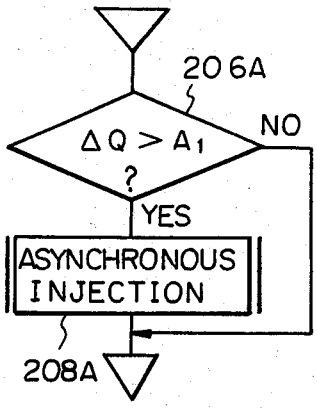

In FIG. 4A, at step 206A, the intake air amount data Q is read out of the RAM 107, and the variation ΔQ is calculated. That is, $$\Delta Q \leftarrow Q - Q0$$

where Q0 is the previous value of Q. Then, it is determined whether or not $\Delta Q > A_1$ (definite value) is satisfied. Only when $\Delta Q > A_1$, does the control proceed to step 208A which is the same as the step 208 of FIG. 2. Thus, an acceleration state is detected by the variation of the intake air amount Q.

Figure 4B:
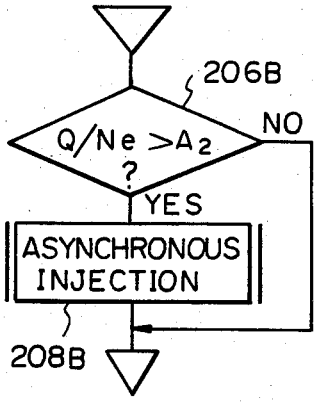

In FIG. 4B, at step 206B, the intake air amount data Q and the engine speed data $N_e$ are read out of the RAM 107, and the intake air amount per one revolution, i.e., $Q/N_e$. Then, it is determined whether or not $Q/N_e > A_2$ (definite value) is satisfied. Only when $Q/N_e > A_2$, does the control proceed to step 208B which is the same as step 208 of FIG. 2. Thus, an acceleration state is detected by the intake air amount per one revolution $Q/N_e$.

Figure 4C:
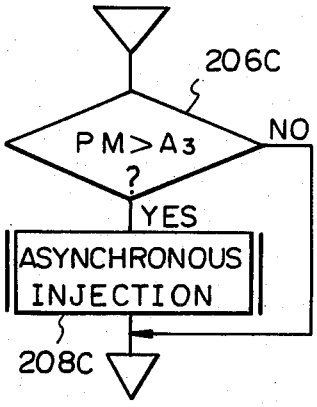

In FIG. 4C, at step 206C, the intake air pressure PM is fetched from the pressure sensor (not shown), and the variation ΔPM is calculated. That is, $$PM \leftarrow PM - PM0$$

where PM0 is the previous value of PM. Then, it is determined whether or not $\Delta PM > A_3$ (definite value) is satisfied. Only when $\Delta PM > A_3$, does the control proceed to step 208C which is the same as step 208 of FIG. 2. Thus, an acceleration state is detected by the variation of the intake air pressure PM.

Figure 4D:
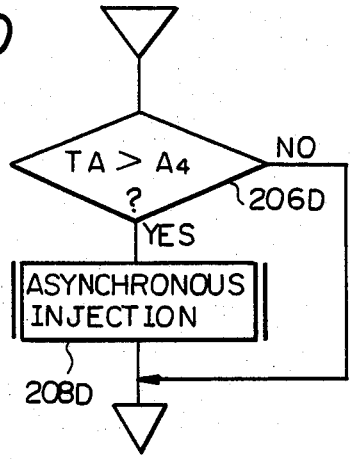

In FIG. 4D, at step 206D, the opening TA of the throttle value 4 rs fetched from the throttle sensor (not shown) which generates an analog signal in proportion to the opening TA, and the variation ΔTA is calculated. That is, $$\Delta TA \leftarrow TA - TA0$$

where TA0 is the previous value of TA. Then, it is determined whether or not $\Delta TA > A_4$ (definite value) is satisfied. Only when $\Delta TA > A_4$, does the control proceed to step 208D which is the same as step 208 of FIG. 2. Thus, an acceleration state is detected by the variation of the opening TA of the throttle value 4.

Figure 4E:
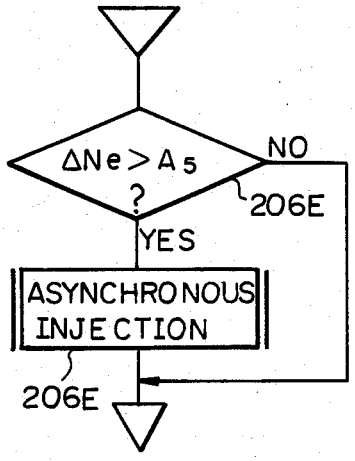

In FIG. 4E, at step 206E, the engine speed data $N_e$ is read out of the RAM107, and the variation $\Delta N_e$ is calculated. That is, $$\Delta N_e \leftarrow N_e - N0$$

where N0 is the previous value of $N_e$. Then, it is determined whether or not $\Delta N_e > A_5$, (definite value) is satisfied. Only when $\Delta N_e > A_5$, does the control proceed to step 208E which is the same as step 208 of FIG. 2. Thus, an acceleration state is detected by the variation of the engine speed $N_e$.

Figure 5:
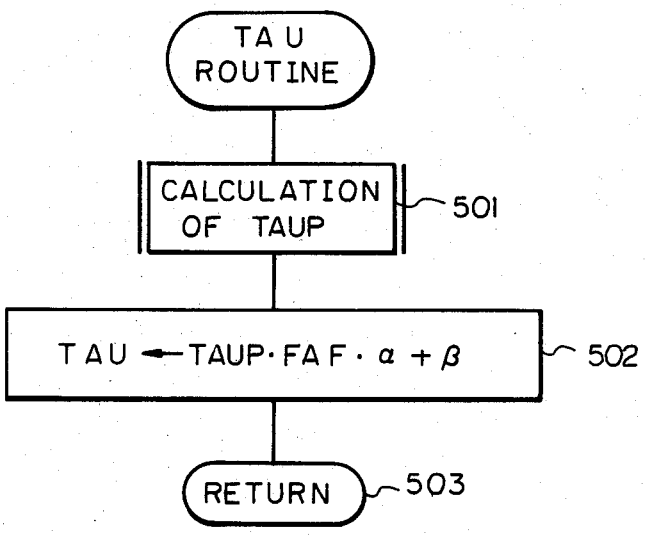

FIG. 5 is a routine for calculating a fuel injection time period TAU for a synchronous injection in synchronization with the engine speed $N_e$. This routine is, therefore, executed at every predetermined crank angle. For example, this routine is executed at every 360° CA in a simultaneous fuel injection system for simultaneously injecting all the injectors and is executed at every 180° CA in a sequential fuel injection system applied to a four-cylinder engine for sequentially injecting the injectors thereof.

At step 501, a base fuel injection time period TAUP is calculated from a two-dimensional map stored in the ROM 106 by using the parameters Q and $N_e$. Then, at step 502, a final fuel injection time period TAU is calculated by $$TAU \leftarrow TAUP \cdot FAF \cdot \alpha + \beta$$

where FAF is an air-fuel ratio feedback coefficient, and $\alpha$ and $\beta$ are correction factors determined by other parameters such as the signal of the intake air temperature sensor, the voltage of the battery (both not shown), and the like. Then the calculated fuel injection time period TAU is stored in the RAM 107, and the routine of FIG. 5 is completed by step 503.

Figure 6:
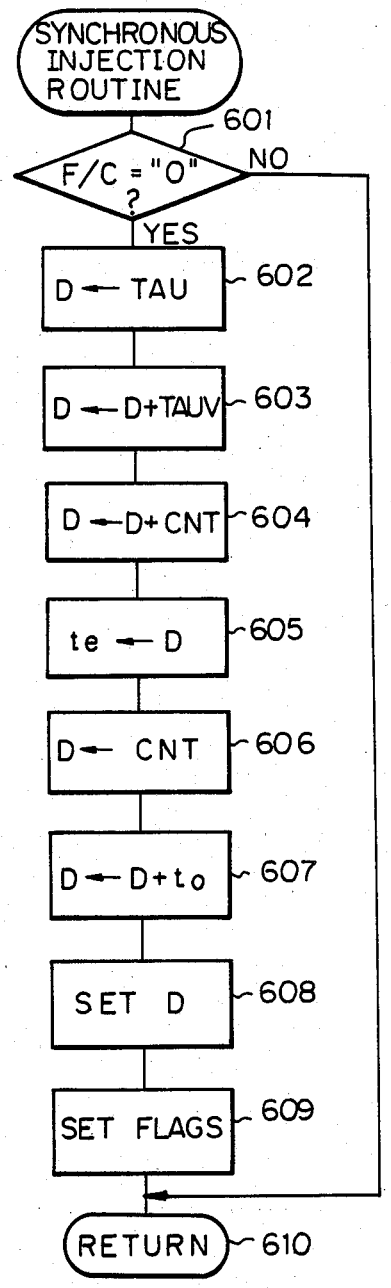

FIG. 6 is a routine for controlling the fuel injection in accordance with the fuel injection time period TAU calculated by the routine of FIG. 5, executed at every predetermined crank angle. Also, this routine is executed at every 360° CA in a simultaneous fuel injection system and is executed at every 180° CA in an sequential fuel injection system applied to a four-cylinder engine.

At step 601, it is determined whether or not the fuel cut-off flag F/C is "0". If F/C="1", then the control proceeds directly to step 610, thus not carrying out a fuel injection. Otherwise, the control proceeds to step 602.

At step 602, the fuel injection time period TAU stored in the RAM 107 is read out and is transmitted to the D register (not shown) included in the CPU 104. At step 603, an invalid fuel injection time period TAUV, which is also stored in the RAM 107, is added to the content of the D register. In addition, at step 604, the current time CNT of the free-run counter of the timer counter 105 is read out and is added to the content of the D register, thereby obtaining an injection end time $t_e$ in the D register. Therefore, at step 605, the content of the D register is stored as the injection end time $t_e$ in the RAM 107.

Again at step 606, the current time CNT of the free-run counter is read out and is set in the D register. Then, at step 607, a small time period $t_0$, which is definite or determined by the predetermined parameters, is added to the content of the D register. At step 608, the content of the D register is set in the compare register of the timer counter 105, and at step 609, a fuel injection execution flag and a compare interrupt permission flag are set in the registers of the timer counter 106. The routine of FIG. 6 is completed by step 610.

Figure 7:
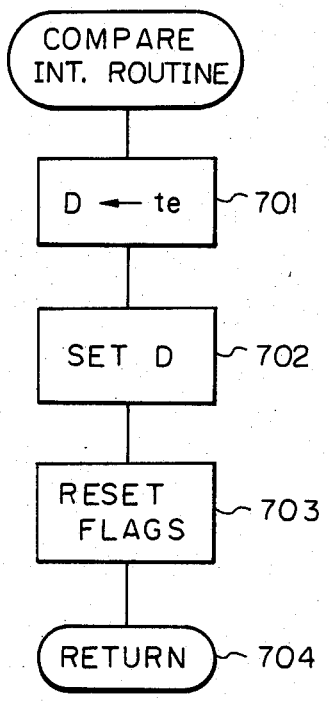

Thus, when the current time CNT of the free-run counter reaches the compare register, an injection-on signal due to the presence of the fuel injection execution flag is transmitted from the timer counter 105 via the I/O interface 102 to the driver circuit 103, thereby initiating fuel injection by the fuel injection valve 9. Simultaneously, a compare interrupt signal due to the presence of the compare interrupt permission flag is transmitted from the timer counter 105 to the CPU 104, thereby initiating a compare interrupt routine as illustrated in FIG. 7.

The completion of the fuel injection will be explained with reference to FIG. 7. At step 701, the injection end time $t_e$ store in the RAM 107 is read out and is transmitted to the D register. At step 702, the content of the D register is set in the compare register of the timer counter 105 and at step 703, the fuel injection execution flag and the compare interrupt permission flag are reset. The routine of FIG. 7 is completed by step 704.

Thus, when the current time CNT of the free-run counter reaches the compare register, an injection-off signal due to the absence of the fuel injection execution flag is transmitted from the timer counter 105 via the I/O interface 102 to the drive circuit 103, thereby ending the fuel injection by the fuel injection valve 9. In this case, however, no compare interrupt signal is generated due to the absence of the compare interrupt permission flag.

Thus, fuel injection of the fuel injection valve 9 is carried out for the time period TAU.

The asynchronous injection carried out at step 208 of FIG. 2 will be explained hereinafter.

Figure 8:
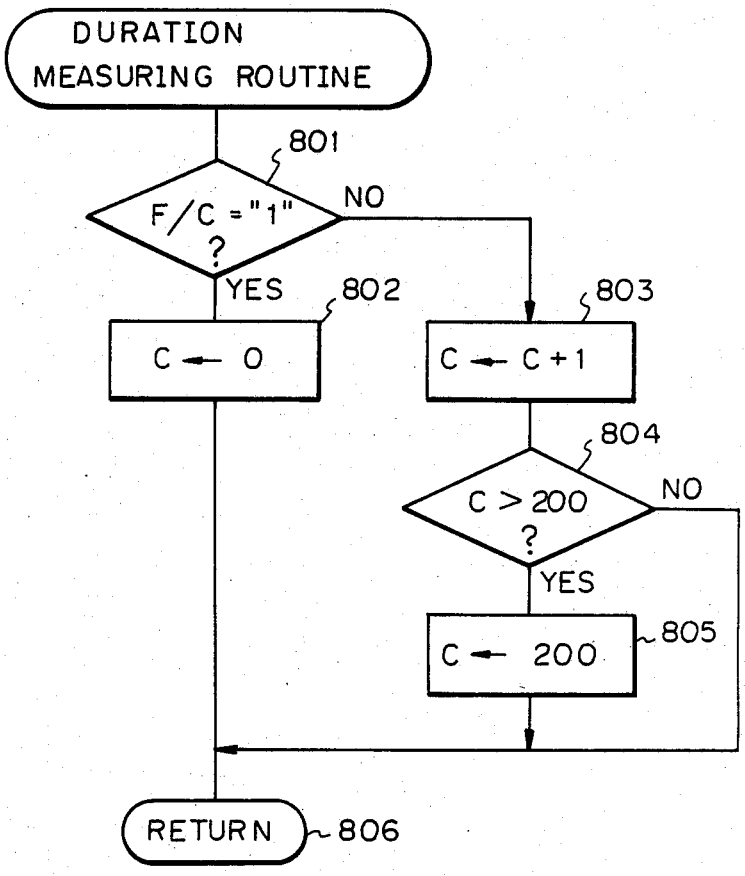

First, the measure of the duration of the period after the fuel cut-off recovery is explained with reference to the routine of FIG. 8. This routine is carried out at every predetermined crank angle such as 180° CA, but can be carried out at every predetermined time period. At step 801, it is determined whether or not the fuel cut-off flag F/C is "1". If F/C="1", the control proceeds to step 802 which clears the counter C. Otherwise, the control proceeds to step 803 which increments the counter C by 1. At steps 804 and 805, the counter C is guarded by a maximum value such as 200, thereby stopping the counter C from overflowing. Then, the routine of FIG. 8 is completed by step 806.

Figure 9:
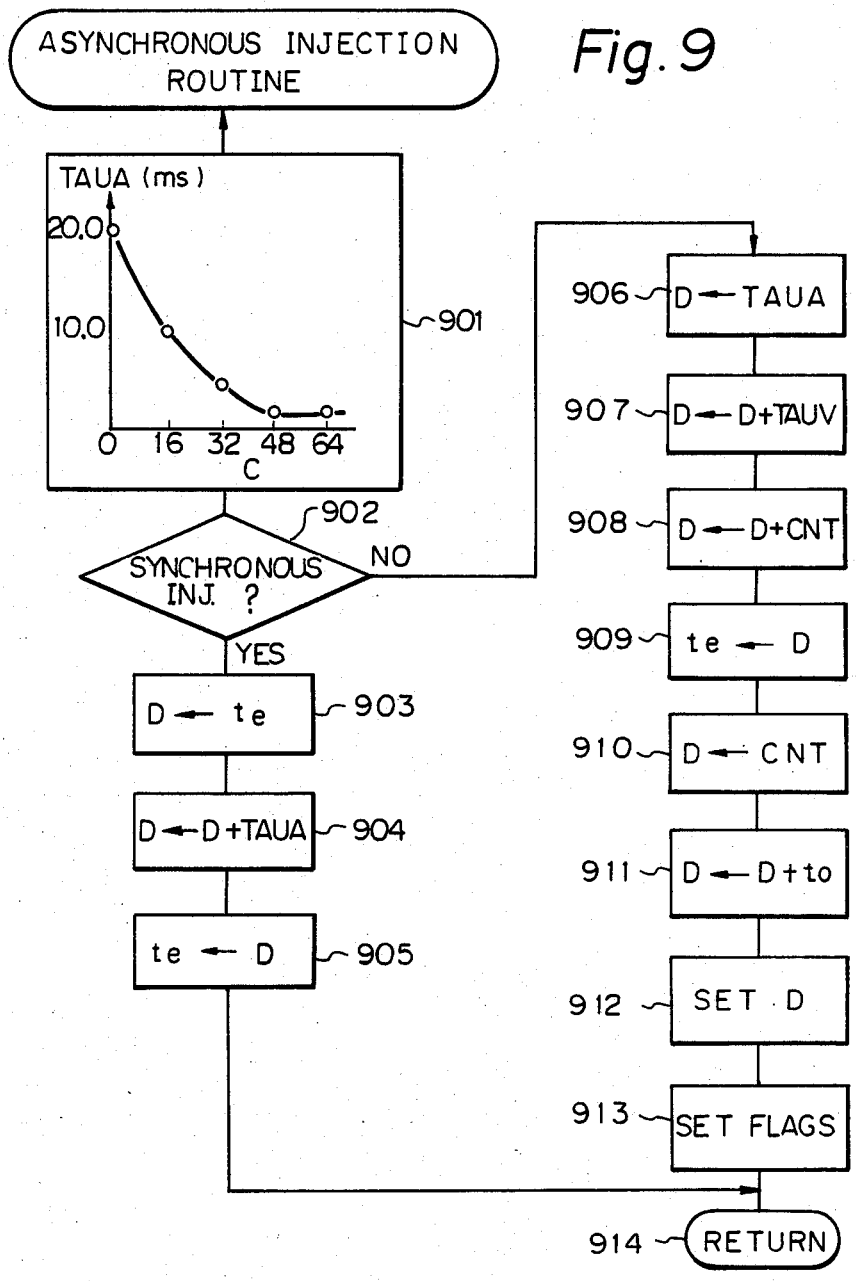

In FIG. 9, which is a detailed flow chart of step 208 of FIG. 2, at step 901 an asynchronous fuel time period TAUA is calculated from a one-dimensional map stored in the ROM 106 by using the parameter C as shown in the block of step 901. Note that the asynchronous time period TAUA is larger when the counter C is smaller. At step 902, it is determined whether or not a synchronous injection executed by the routine 6 is being carried out, i.e., whether the fuel injection execution flag of the timer counter 105 is set or reset. If the fuel injection execution flag is set, the control proceeds to steps 903 through 905 which prolong the fuel injection end time $t_e$. Contrary to this, if the fuel injection execution flag is reset, the control proceeds to steps 906 through 913 which set the asynchronous fuel injection time period TAUA in the timer counter 105.

That is, at step 903, the fuel injection end time $t_e$ is read from the RAM 107 to the D register, and at step 904, the asynchronous injection time period TAUA is added to the content of the D register. Then, at step 905, the content of the D register is stored in the RAM 107. Thus, the fuel injection end time $t_e$ is prolonged by the asynchronous injection time period TAUA.

On the other hand, the asynchronous injection time period TAUA is transmitted to the D register. After that, the flow goes to steps 907 through 913, which are the same as steps 603 through 609 of FIG. 6, respectively. Thus, in this case, fuel injection of the fuel injection valve 9 is carried out for the time period TAUA.

The routine of FIG. 9 is completed by step 914.

Note that, in the above-mentioned embodiment, although an asynchronous injection is carried out after the fuel cut-off recovery, it is possible to add the amount of fuel corresponding to the asynchronous injection amount TAUA to a plurality of synchronous injection pulses. That is, in FIG. 10, which is a modification of FIG. 5, at step 1001, it is determined whether or not an acceleration state is detected by the output of the idling-position switch 5, the intake air amount Q, or the like. At step 1002, an acceleration enrichment time period TAUA' is calculated from a one-dimensional map stored in the ROM 106 by using the parameter C as shown in the block of step 1002. In this case, the value TAUA' is 1/10 of the value TAUA of step 901 of FIG. 9. Then at step 1003, the content of the counter M is brought to a predetermined value M0 such as 10.

As step 1008, a base fuel injection time period TAUP is calculated from a two-dimensional map stored in the ROM 106 by using the parameters Q and $N_e$. Then, at step 1009, a final fuel injection time period TAU is calculated by $$TAU \leftarrow TAUP \cdot FAF \cdot \alpha + \beta + TAUA'$$

Then, the routine of FIG. 10 is again carried out, and the flow at step 1001 proceeds to steps 1004 through 1007. At step 1004, the counter M is decremented by 1, and at steps 1005 and 1006, the counter M is guarded by a minimum value which is, in this case, 0. If $M \leqq O$ at step 1005, the acceleration fuel enrichment time period TAUA' is cleared.

Thus, the acceleration fuel enrichment time period TAUA' attributes to the synchronous injection time period TAU for ten cycles of synchronous injections.

Figure 10:
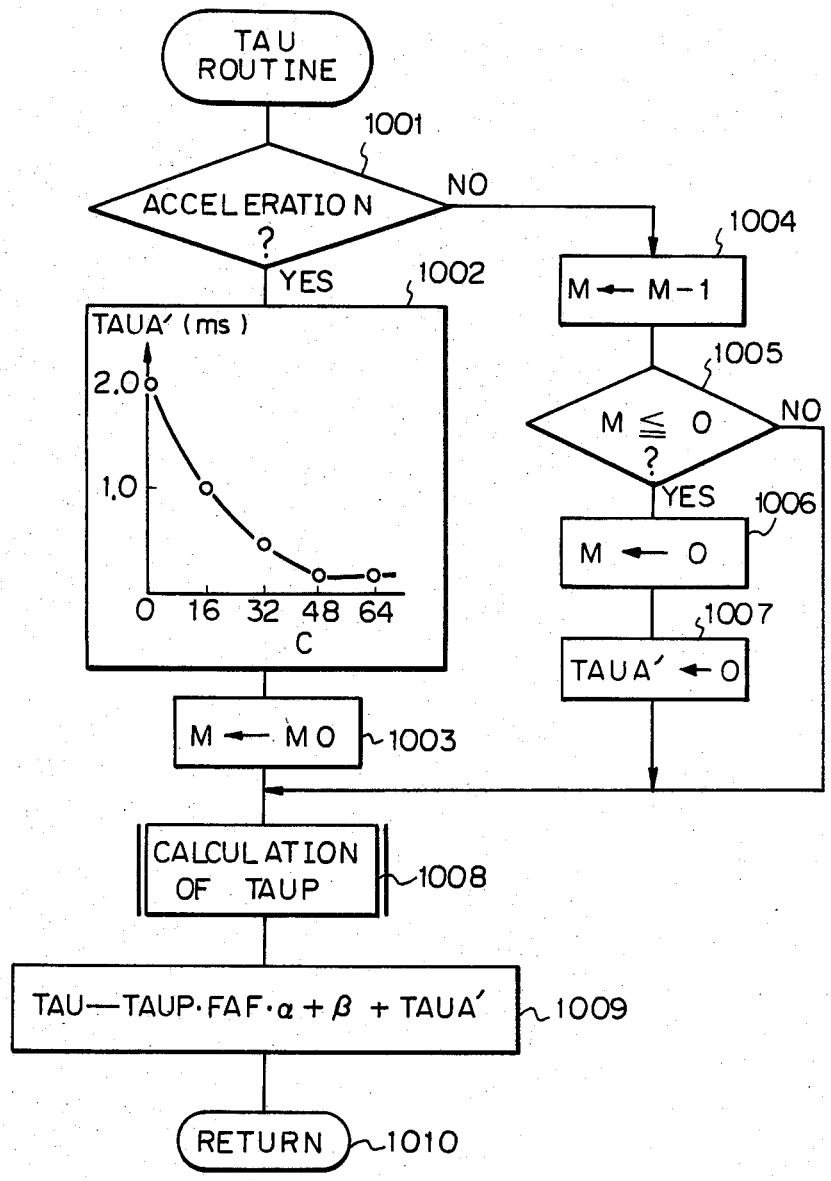

The routine of FIG. 10 is completed by step 1010.

Figures 11A, 11B, 11C, 11D, 11E:
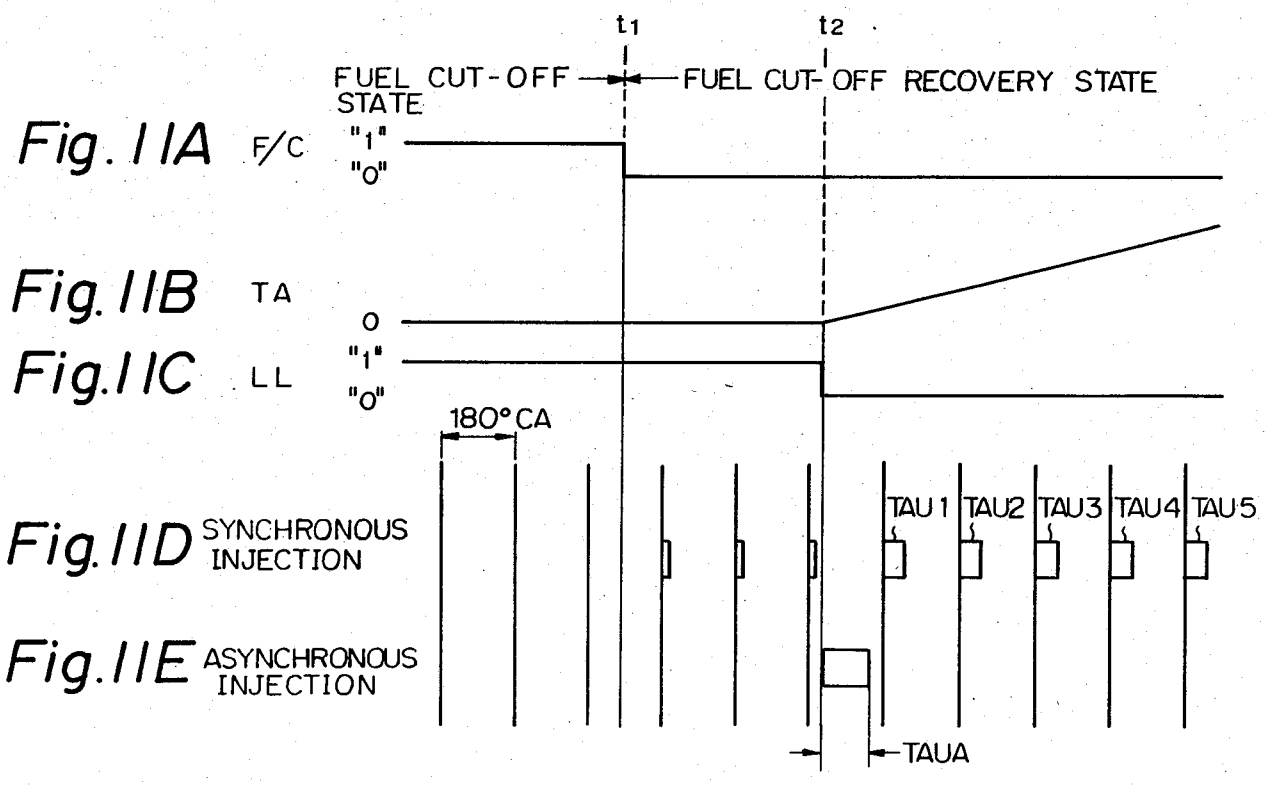
FIGS. 11A through 11E are timing diagrams showing operation of the control circuit of FIG. 1.

Further, referring to FIGS. 11A through 11E, which are diagrams complementarily explaining the operation of the control circuit 10 of FIG. 2, at time $t_1$, when the fuel cut-off flag F/C is changed from "1" to "0" as shown in Fig. 11A, a synchronous injection at, for example, each 180° CA timing, is initiated as shown in Fig. 11D. Next, at time $t_2$, when the opening TA of the throttle valve 4 increases as shown in Fig. 11B, the output signal LL of the idling position switch 5 is changed from "1" to "0" as shown in Fig. 11C. At this time, it is considered that an acceleration state is detected. Therefore, an asynchronous injection is carried out as shown in Fig. 11E. In this case, the asynchronous injection amount TAUA is calculated on the basis that the counter C equals 3. If the asynchronous injection time period TAUA is superimposed onto one of the synchronous injection time periods TAU1, TAU2, . . . , this synchronous injection time period is prolonged by the time period TAUA. Further, instead of carrying out the asynchronous injection, predetermined parts of the synchronous injection time periods TAU1, TAU2, . . . are prolonged.

Figure 12:
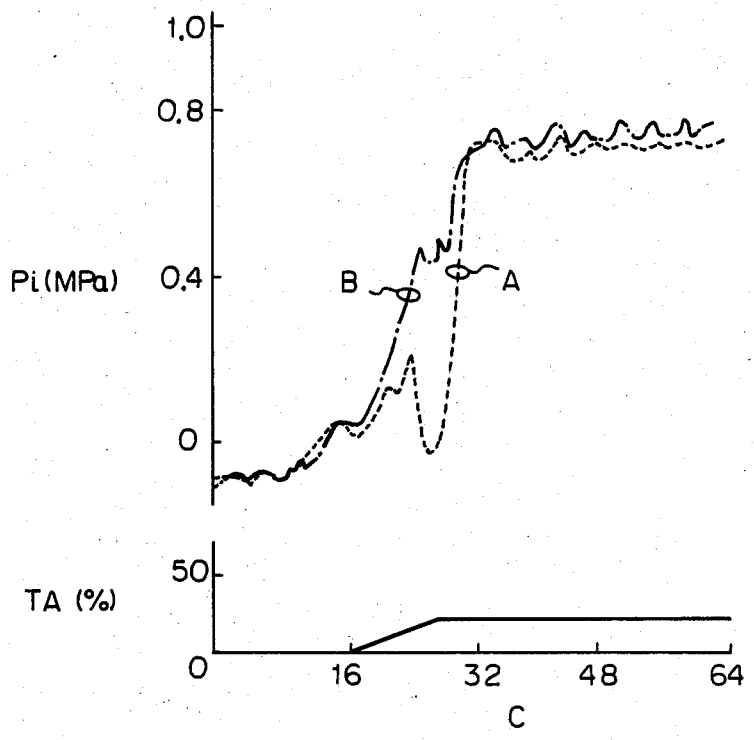
FIG. 12 is a graph showing the effect according to the present invention.

In FIG. 12, which shows the effect of the present invention, the abscissa shows the value of counter C, and the ordinate shows the combustion pressure $P_i$ and the throttle valve opening TA. Here the curve A shows the case where no fuel enrichment is carried out as in the prior art, while the curve B shows the case where fuel enrichment is carried out at an acceleration mode after the fuel cut-off recovery according to the present invention. Thus, lag or vibration are clearly reduced. In addition, since the fuel enrichment is determined in consideration of the synchronous injection amount from the fuel cut-off recovery to the detection of an acceleration state, the fuel consumption is improved.

Note that the present invention can be applied to internal combustion engines other than an SPI type combustion engine.

What is claimed is:

1. A method for controlling the air-fuel ratio in an internal combustion engine having a throttle valve therein, comprising the steps of:

detecting a transition of said engine from a fuel cut-off state to a fuel cut-off recovery state;

measuring a duration period after the transition from the fuel cut-off state to the fuel cut-off recovery state;

detecting an acceleration state of said engine;

calculating a fuel enrichment in accordance with the measured duration of said period, when an acceleration state is detected in said engine; and incrementing fuel to be supplied to said engine by said fuel enrichment.

2. A method as set forth in claim 1, wherein said fuel incrementing step comprises a step of supplying said fuel enrichment to said engine in synchronization of the rotation thereof.

3. A method as set forth in claim 1, wherein said period duration measuring step comprises a step of measuring the number of rotations of said engine after the transition of the fuel cut-off state to the fuel cut-off recovery state.

4. A method as set forth in claim 1, wherein said duration measuring step comprises a step of measuring the time duration after the transition of the fuel cut-off state to the fuel cut-off recovery state.

5. A method as set forth in claim 1, wherein said acceleration detecting step comprises a step of detecting said acceleration state by determining whether or not said throttle valve is completely closed.

6. A method as set forth in claim 1, wherein said acceleration detecting step comprises a step of detecting said acceleration state by determining whether or not a variation of the intake air amount of said engine is larger than a predetermined value.

7. A method as set forth in claim 1, wherein said acceleration detecting step comprises a step of detecting said acceleration state by determining whether or not the intake air amount per one revolution of said engine is larger than a predetermined value.

8. A method as set forth in claim 1, wherein said acceleration detecting step comprises a step of detecting said acceleration state by determining whether or not the intake air pressure of said engine is larger than a predetermined value.

9. A method as set forth in claim 1, wherein said acceleration detecting step comprises a step of detecting said acceleration state by determining whether or not the opening of said throttle valve is larger than a predetermined value.

10. A method as set forth in claim 1, wherein said acceleration detecting step comprises a step of detecting said acceleration state by determining whether or not a variation of the speed of said engine is larger than a predetermined value.

11. A method as set forth in claim 1, wherein said fuel incrementing step comprises a step of asynchronously supplying said fuel enrichment to said engine.

12. A method as set forth in claim 11, further comprising the steps of:

determining whether or not fuel is being supplied to said engine in synchronization with the rotation thereof, when said asynchronous fuel enrichment supplying step is carried out, and prolonging the time period of supplying fuel to said engine in synchronization with the rotation thereof by a time period corresponding to said asynchronous fuel enrichment, when fuel is being supplied to said engine in synchronization with the rotation thereof.

13. An apparatus for controlling the air-fuel ratio in an internal combustion engine having a throttle valve therein, comprising:

means for detecting a transition of said engine from a fuel cut-off state to a fuel cut-off recovery state;

means for measuring a duration period after the transition from the fuel cut-off state to the fuel cut-off recovery state;

means for detecting an acceleration state of said engine;

means for calculating a fuel enrichment in accordance with the measured duration of said period, when an acceleration state is detected in said engine; and means for incrementing fuel to be supplied to said engine by said fuel enrichment.

14. An apparatus as set forth in claim 13, wherein said fuel incrementing means comprises means for supplying said fuel enrichment to said engine in synchronization with the rotation thereof.

15. An apparatus as set forth in claim 13, wherein said period duration measuring means comprises means for measuring the number of rotations of said engine after the transition of the fuel cut-off state to the fuel cut-off recovery state.

16. An apparatus as set forth in claim 13, wherein said period duration measuring means comprises a step of measuring the time duration after the transition of the fuel cut-off state to the fuel cut-off recovery state.

17. An apparatus as set forth in claim 13, wherein said acceleration detecting means comprises means for detecting said acceleration state by determining whether or not said throttle valve is completely closed.

18. An apparatus as set forth in claim 13, wherein said acceleration detecting means comprises means for detecting said acceleration state by determining whether or not a variation of the intake air amount of said engine is larger than a predetermined value.

19. An apparatus as set forth in claim 13, wherein said acceleration detecting means comprises means for detecting said acceleration state by determining whether or not the intake air amount per one revolution of said engine is larger than a predetermined value.

20. An apparatus as set forth in claim 13, wherein said acceleration detecting means comprises means for detecting said acceleration state by determining whether or not the intake air pressure of said engine is larger than a predetermined value.

21. An apparatus as set forth in claim 13, wherein said acceleration detecting means comprises means for detecting said acceleration state by determining whether or not the opening of said throttle valve is larger than a predetermined value.

22. An apparatus as set forth in claim 13, wherein said acceleration detecting means comprises means for detecting said acceleration state by determining whether or not a variation of the speed of said engine is larger than a predetermined value.

23. An apparatus as set forth in claim 13, wherein said fuel incrementing means comprises means for asynchronously supplying said fuel enrichment to said engine.

24. An apparatus as set forth in claim 23, further comprising:

means for determining whether or not fuel is being supplied to said engine in synchronization with the rotation thereof, when said said fuel incrementing means supplies asynchronous fuel enrichment to said engine, and means for prolonging the time period of supplying fuel to said engine in synchronization with the rotation thereof by a time period corresponding to said asynchronous fuel enrichment, when fuel is being supplied to said engine in synchronization with the rotation thereof.

* * * * *

UNITED STATES PATENT AND TRADEMARK OFFICE

CERTIFICATE OF CORRECTION

PATENT NO. : 4,655,179

DATED : 7 April 1987

INVENTOR(S) : Toshimi KASHIWAGURA

It is certified that error appears in the above-identified patent and that said Letters Patent is hereby corrected as shown below:

Col. 4, line 56: change "rs" to --is--.
Col. 5, line 2: change "RAM107" to --RAM 107--.
Col. 5, line 42: change "an" to --a--.
Col. 6, line 17: change "store" to --stored--.

Signed and Sealed this

Twenty-fourth Day of November, 1987

*Attest:*

DONALD J. QUIGG

*Attesting Officer*

*Commissioner of Patents and Trademarks*